US007030839B2

(12) United States Patent
Higashino et al.

(10) Patent No.: US 7,030,839 B2
(45) Date of Patent: Apr. 18, 2006

(54) METHOD FOR DRIVING PLASMA DISPLAY PANEL AND PLASMA DISPLAY PANEL

(75) Inventors: Hidetaka Higashino, Kyoto (JP); Nobuaki Nagao, Katano (JP)

(73) Assignee: Matsushita Electric Industrial Co., Ltd, Osaka (JP)

( * ) Notice: Subject to any disclaimer, the term of this patent is extended or adjusted under 35 U.S.C. 154(b) by 238 days.

(21) Appl. No.: 10/149,568

(22) PCT Filed: Dec. 8, 2000

(86) PCT No.: PCT/JP00/08740

§ 371 (c)(1),
(2), (4) Date: Aug. 27, 2002

(87) PCT Pub. No.: WO01/45077

PCT Pub. Date: Jun. 21, 2001

(65) Prior Publication Data

US 2003/0020674 A1 Jan. 30, 2003

(30) Foreign Application Priority Data

Dec. 14, 1999 (JP) ..... 11-354297

(51) Int. Cl.
*G09G 3/28* (2006.01)

(52) U.S. Cl. ..... 345/60; 345/63

(58) Field of Classification Search ..... 345/37, 345/41, 60, 67, 68, 63; 315/169.1, 169, 169.4
See application file for complete search history.

(56) References Cited

U.S. PATENT DOCUMENTS

| | | | | |
|---|---|---|---|---|
| 5,745,086 | A * | 4/1998 | Weber | 345/63 |
| 6,118,214 | A * | 9/2000 | Marcotte | 345/67 |
| 6,127,992 | A * | 10/2000 | Sano | 345/60 |
| 6,150,766 | A * | 11/2000 | Shino et al. | 315/169.4 |
| 6,160,530 | A * | 12/2000 | Makino | 345/60 |
| 6,492,964 | B1 * | 12/2002 | Mikoshiba et al. | 345/60 |
| 6,573,878 | B1 * | 6/2003 | Mizobata | 345/60 |
| 6,636,187 | B1 * | 10/2003 | Tajima et al. | 345/55 |
| 6,731,275 | B1 * | 5/2004 | Mizobata | 345/209 |
| 6,734,844 | B1 * | 5/2004 | Mizobata | 345/208 |
| 6,806,858 | B1 * | 10/2004 | Kurumisawa et al. | 345/94 |
| 2003/0030608 | A1 * | 2/2003 | Kurumisawa et al. | 345/87 |

FOREIGN PATENT DOCUMENTS

| | | |
|---|---|---|
| EP | 0325086 | 7/1989 |
| JP | 10-301529 | 11/1998 |
| JP | 11-65518 | 3/1999 |
| JP | 2000-066635 | 3/2000 |
| JP | 2000-066636 | 3/2000 |
| JP | 2000-305515 | 11/2000 |
| WO | WO 97/20301 | 6/1997 |

* cited by examiner

*Primary Examiner*—Amare Mengistu

(57) ABSTRACT

A plasma display panel (PDP) drive method eliminates crosstalk and allows for high quality image display by preventing erroneous discharge from occurring in an address period. The method includes an address step of writing data by applying an address pulse to a third electrode and a scan pulse Pas1 sequentially to first electrodes, and a sustain step of sustaining an illumination by applying sustain pulses between first and second electrodes after completion of the address step. Furthermore, in the address step, a scan pulse Pas2 of opposite polarity to scan pulse Pas1 is applied to a second electrode in a pair with a first electrode in a selected line (i.e. a line in which scan pulse Pas1 is being applied).

17 Claims, 6 Drawing Sheets

Drive Waveforms of 1 Subfield

METHOD FOR DRIVING PLASMA DISPLAY PANEL AND PLASMA DISPLAY PANEL

TECHNICAL FIELD

The invention relates to a plasma display panel (PDP) drive method and a plasma display device used for image display in computers, televisions, and the like.

BACKGROUND ART

Developments in cathode-ray tube (CRT), liquid crystal display (LCD), and plasma display panel (PDP) technology has been spurred in recent years by increasing demand for large screen televisions having high definition capabilities, an example of which is hi-vision.

CRTs, currently the most widely used type of display, exhibit excellent resolution and image quality characteristics, although the substantial increases in unit depth and weight that accompany increases in screen size make CRTs unsuitable for large-screen 40 inch plus applications. The advantage of LCDs, on the other hand, lies in their economical power usage and the consequent low drive voltages. There are, however, technical difficulties associated with enlarging the screen size of LCD displays, and also limitations concerning the viewing angle.

In comparison, PDPs are readily suitable for thin large-screen applications, and 40-inch class models have already been developed.

PDPs can be divided into AC-type and DC-type, the former currently considered the most suitable for large-screen applications. PDPs are also well suited for high-definition image display.

The general structure of known PDP technology is shown in FIGS. 1, 2 and 3. FIG. 1 is a perspective view of a main section of a prior art PDP. FIG. 2 shows a vertical cross-section of the main section along the X—X axis of FIG. 1. FIG. 3 shows a vertical cross-section of the main section along the Y—Y axis of FIG. 1.

A PDP is generally formed from a front panel PA1 and a back panel PA2, the two panels being affixed together around their respective peripheries. Front panel PA1 includes a first glass substrate 100. Plural pairs of display electrodes (first electrode 101*a* and second electrode 101*b*) are provided on substrate 100 so as to form a parallel stripe-pattern, one pair of which is shown in FIG. 1. A dielectric glass layer 102 composed of lead glass or the like is formed over the display electrodes. Layer 102 is covered with a magnesium oxide (MgO) protective layer 103 composed of an MgO evaporation film or the like.

Back panel PA2 includes a second glass substrate 110. A plurality of address electrodes (third electrodes 111) is provided in a parallel stripe-pattern on substrate 110. A dielectric glass layer 112 composed of lead glass or the like is formed over the third electrodes 111. A plurality of ribs 113 is arranged in a stripe-pattern on layer 112 so as to lie between and extend parallel to third electrodes 111. Phosphor layers 114 comprising the colors red (R), green (G), and blue (B), respectively, are formed between adjacent ribs 113.

Front panel PA1 and back panel PA2 are affixed together such that the first and second electrodes extend in an orthogonal direction to the third electrodes. A discharge gap composed of xenon, neon, argon, or the like, is enclosed in a space defined between the affixed front and back panels.

In the above structure, the first and second electrodes are arranged so as to define a discharge gap therebetween. The known PDP also includes a plurality of discharge cells CL, each cell CL being formed in a region where a single first electrode 101*a* and a single second electrode 101*b* extend across a single third electrode 111.

The following is a detailed description of a method for driving the known PDP, with reference to FIG. 4. The method used is a conventional field timesharing display method. The description relates to the driving of the known PDP in a single subfield. FIG. 4 shows drive waveforms pertaining to the subfield, "VX" denoting the amplitude of the various pulses. In FIG. 4, the $i^{th}$ line refers to the order in which the pair of electrodes in the line is scanned when data is written (i.e. addressed). The $j^{th}$ column, on the other hand, refers to the positioning of the third electrode 111 in relation to third electrodes in other columns.

As shown in FIG. 4 with respect to the first electrodes 101*a*, a positive initializing pulse (V1+V2) is applied in a first initializing period T1, and a positive initializing pulse V2 is applied in a second initializing period T2. With respect to the second electrodes 101*b*, a positive initializing pulse V2 is applied in the second initializing period T2, this pulse initializing a wall charge within the discharge cells CL.

In address period T3, a negative scan pulse V3 is applied to the $i^{th}$ line first electrode 101*a* and a positive address pulse V4 is applied to the $j^{th}$ column third electrode 111 corresponding to the discharge cell to be written (i.e. the cell positioned at an intersection of the $i^{th}$ line and the $j^{th}$ column).

As a result, an address discharge is generated between the first electrode 101*a* ($i^{th}$ line) and the address electrode 111 ($j^{th}$ column) in the cell in which the address pulse V4 was applied. This in turn initiates a surface discharge between the first and second electrodes in the $i^{th}$ line, wall charge being stored on the surface of dielectric layer 102 between the pair of electrodes subsequent to this discharge.

As a result of a continuous scanning of the first and third electrodes, increasing amounts of wall charge are stored on dielectric layer 102 in the discharge cells to be used for image display. It is this accumulation of wall charge that allows one screen of latent image to be written.

In a sustain period T4, the address electrodes are grounded and sustain pulses V5 are applied alternately to the first and second electrodes, thus generating a sustain discharge in the discharge cells having wall charge stored on dielectric layer 102. By weighting the illumination according to the number of sustain pulses applied in the period T4, it is possible to express gradations corresponding to the weights of the various sustain pulses.

In an erase period T5, an erase pulse V6 is applied to the second electrodes 101*b*, the amplitude of pulse V6 being substantially the same as that of pulse V5 and its duration being relatively short. A weak discharge is generated as a result, eliminating the wall charge, and thus erasing the latent image.

In the known PDP, one subfield of image display is generally conducted by consecutively performing the initializing period, the address period, the sustain period, and the erase period.

According to the prior art drive method described above, a potential of the first and second electrodes in the selected $i^{th}$ scan line is maintained at V0 and V2, respectively, in the address period. In other words, the potential V2 equals the voltage between the first and second electrodes in the discharge cell at the completion of the initializing period; that is, slightly lower than a discharge initiating voltage Vfs.

When address pulse V4 is applied to a third electrode 111, an address discharge occurs between the first and third electrodes, and priming particles are formed. The discharge initiating voltage Vfs between first and second electrodes decreases as a result of the priming particles, and a surface discharge is initiated between the first and second electrodes. Wall charge is stored as a result of the surface discharge, and a latent image is consequently written in the cells storing wall charge.

Also, the discharge initiating voltage Vfs applied between the first and second electrodes in cells that are in lines adjacent to the $i^{th}$ line (i.e. the already scanned $i-1^{th}$ line and the $i+1^{th}$ line to be scanned) is reduced when priming particles generated in the an $i^{th}$ line cell cross over into a cell in an adjacent line, this being a phenomenon that sometimes occurs.

Under normal circumstances, maintaining the potential of the first electrodes in the $i-1^{th}$ and $i+1^{th}$ lines at a positive voltage V3 allows the voltage occurring at the second electrodes in these respective lines to be established at a magnitude that is slightly lower than the discharge initiating voltage Vfs (when no priming has occurred) minus the voltage V3 (i.e. Vfs−V3). As a result, no address discharge is generated in cells that are in lines adjacent to the $i^{th}$ line.

However, when priming particles crossover into lines adjacent to the $i^{th}$ line, causing the discharge initiating voltage Vfs to decrease in the cells in these lines, there exists the possibility that an erroneous discharge will be initiated between the first and second electrodes in these cells in period T4. This erroneous display discharge occurs irrespective of whether the particular cells have been addressed or not, and is a phenomenon referred to as "crosstalk". The elimination of crosstalk is one of the major tasks confronting PDP designer in their efforts toward improving image quality in PDPs.

The gravity of the problem is compounded by the fact that the frequency of crosstalk increases as cell size is reduced in high definition PDPs.

DISCLOSURE OF INVENTION

With a view to overcoming the problems discussed above, an object of the invention is to provide a plasma display panel (PDP) drive method and a plasma display device that prevent erroneous discharge from occurring in the address period. Crosstalk can thus be eliminated and high quality image display achieved.

A PDP drive method provided to achieve this object uses a field timesharing display method to drive the PDP. The PDP has a first panel member and a second panel member, a plurality of first and second electrodes being provided on the first panel member so as to extend parallel to each other, and a plurality of third electrodes being provided on the second panel member so as to extend orthogonally to the first and second electrodes. The method includes an address step of writing data by applying an address pulse to a third electrode and a first scan pulse sequentially to the first electrodes, and a sustain step of sustaining an illumination by applying a sustain pulse between the first and second electrodes after completion of the address step. In the address step, a second scan pulse of opposite polarity to the first scan pulse is applied to a second electrode in a pair with a first electrode to which the first scan pulse is being applied, and display of an image in a subfield of a field is achieved by conducting the address step and the sustain step.

As a result of the scan pulse applied in the address step to the second electrode in a selected line being of opposite polarity to the scan pulse applied to the first electrode in the selected line, it possible to shift a base potential of the second electrodes in the same direction (i.e. an amplitude direction) as the polarity of the scan pulse applied to the first electrode. This effectively reduces the voltage between first and second electrodes in discharge cells in non-selected lines to below the level required for initiating a discharge. Discharge in cells in non-selected lines can thus be prevented, even if priming particles generated from the discharge occurring between the first and third electrodes in a selected line crossover into a discharge cell in a non-selected line. As a result, erroneous addressing (i.e. erroneous writing) can be prevented, crosstalk eliminated, and image quality improved.

Applying scan pulses of opposite polarity to the first and second electrodes in a selected line also means that an address discharge is guaranteed in the selected line, despite the base potential of the second electrodes being shifted in the same direction as the polarity of the scan pulse applied to the first electrode.

By way of explanation, the "selection" process referred to here involves the application of predetermined scan pulses to the first and second electrodes in order to write the electrodes.

The possibility of priming particles crossing over from discharge cells in selected lines to cells in non-selected lines is reduced by conducting the addressing as described above, because the voltage between the first electrode in a selected line and a second electrode nearest thereto in a non-selected line has been reduced below the voltage between the first and second electrodes in the selected line (this being effective when first and second electrodes are provided alternately). Combined with the reduced voltage in discharge cells in non-selected lines described above, this proves most effective in preventing erroneous addressing.

In the PDP using the drive method described above, each first electrode may be provided so as be adjacent to another first electrode and each second electrode may be provided so as to be adjacent to another second electrode.

Erroneous discharge can be prevented by employing this electrode configuration, even when the gap between discharge cells is reduced, thereby widening the illumination surface between the electrodes within each of the cells.

The object of the invention may also be achieved by a PDP drive method using a field timesharing display method to drive the PDP. The PDP has a first panel member and a second panel member, a plurality of first and second electrodes being provided on the first panel member so as to extend parallel to each other, and a plurality of third electrodes being provided on the second panel member so as to extend orthogonally to the first and second electrodes. The method includes an address step of writing data by applying an address pulse to a third electrode and a first scan pulse sequentially to the first electrodes, and a sustain step of sustaining an illumination by applying a sustain pulse between the first and second electrodes after completion of the address step. Image display in a subfield of a field is achieved by conducting the address and sustain steps, and in the address step, a second scan pulse is applied to a second electrode in a pair with a first electrode in a selected line such that a voltage between the first and second electrodes in the selected line is greater than a voltage between the first electrode in the selected line and a second electrode nearest thereto in a non-selected line.

The possibility of priming particles crossing over from discharge cells in selected lines to cells in non-selected lines is reduced and erroneous addressing thus prevented by conducting the addressing in this manner, because the voltage between the first electrode in a selected line and a second electrode nearest thereto in a non-selected line is reduced below the voltage between the first and second electrodes in the selected line (this being effective when first and second electrodes are provided alternately).

In the PDP using this drive method, each first electrode may be provided so as be adjacent to another first electrode and each second electrode may be provided so as to be adjacent to another second electrode.

Erroneous discharge can be prevented by employing this electrode configuration, even when the gap between discharge cells is reduced, thereby widening the illumination surface between the electrodes within each of the cells.

In any of the above PDP drive methods, an initializing step of initializing a charge of the PDP can be provided before the address step. The initializing step can include a first initializing step and a second initializing step, the first initializing step applying a positive first initializing pulse to the first electrodes, and the second initializing step applying, after completion of the first initializing step, a positive second initializing pulse to the second electrodes and a positive third initializing pulse to the first electrodes.

Here, the first initializing pulse may have a ramp waveform that increases over time, and the third initializing pulse may have a ramp waveform that decreases over time.

This ramp waveform configuration allows for weak background illumination and high contrast in the initializing step.

Alternatively, the first initializing pulse may have an exponential waveform that exhibits increasing saturation over time, and the third initializing pulse may have an exponential waveform that exhibits decreasing saturation over time.

This exponential waveform configuration allows for weak background illumination and high contrast in the initializing step.

The stated object may also be achieved by a plasma display device that includes a plasma display and a drive unit. The plasma display has a first panel member and a second panel member, a plurality of first and second electrodes being provided on the first panel member so as to extend parallel to each other, and a plurality of third electrodes being provided on the second panel member so as to extend orthogonally to the first and second electrodes. The drive unit operates a field timesharing display method and includes a scan circuit for applying scan pulses of opposite polarities to the first and second electrodes in selected lines.

As a result of the scan pulse applied in the address step to the second electrode in a selected line being of opposite polarity to the scan pulse applied to the first electrode in the selected line, it is possible to shift a base potential of the second electrodes in the same direction (i.e. an amplitude direction) as the polarity of the scan pulse applied to the first electrode. This effectively reduces the voltage between first and second electrodes in discharge cells in non-selected lines to below the level required for initiating a discharge. Discharge in cells in non-selected lines can thus be prevented, even if priming particles generated from the discharge occurring between the first and third electrodes in a selected line crossover into discharge cell in a non-selected line. As a result, erroneous addressing can be prevented, crosstalk eliminated, and image quality improved.

Applying scan pulses of opposite polarity to the first and second electrodes in a selected line also means that an address discharge is guaranteed in the selected line, despite the base potential of the second electrodes being shifted in the same direction as the polarity of the scan pulse applied to the first electrode.

The possibility of priming particles crossing over from a discharge cell in a selected line to a cell in non-selected line is reduced by conducting the addressing in this manner, because the voltage between the first electrode in the selected line and a second electrode nearest thereto in a non-selected line is reduced below the voltage between the first and second electrodes in the selected line (this being effective when first and second electrodes are provided alternately). Combined with the reduced voltage in discharge cells in non-selected lines described above, this proves most effective in preventing erroneous addressing.

In the plasma display, each first electrode may be provided so as be adjacent to another first elect-rode, and each second electrode may be provided so as to be adjacent to another second electrode.

Erroneous discharge can be prevented by employing this electrode configuration, even when the gap between discharge cells is reduced, thereby widening the illumination surface between the electrodes within each of the cells.

The stated object may also be achieved by a plasma display that includes a plasma display and a drive unit. The plasma display has a first panel member and a second panel member, a plurality of first and second electrodes being provided on the first panel member so as to extend parallel to each other, and a plurality of third electrodes being provided on the second panel member so as to extend orthogonally to the first and second electrodes. The drive unit operates a field timesharing display method and includes a scan circuit for applying a first scan pulse and a second scan pulse respectively to a first electrode and a second electrode in a selected line such that a voltage between the first and second electrodes in the selected line is greater than a voltage between the first electrode in the selected line and a second electrode nearest thereto in a non-selected line.

The possibility of priming particles crossing over from a discharge cell in a selected line to a cell in non-selected line is reduced and erroneous addressing thus prevented by conducting the addressing in this manner, because the voltage between the first electrode in the selected line and a second electrode nearest thereto in a non-selected line is reduced below the voltage between the first and second electrodes in the selected line (this being effective when first and second electrodes are provided alternately).

In the plasma display, each first electrode may be provided so as be adjacent to another first electrode, and each second electrode may be provided so as to be adjacent to another second electrode.

Erroneous discharge can be prevented by employing this electrode configuration, even when the gap between discharge cells is reduced, thereby widening the illumination surface between the electrodes within each of the cells.

The drive unit may include an initializing circuit for initializing a charge of the plasma display. The initializing circuit executes a first initializing step for applying a positive first initializing pulse to the first electrodes, and a second initializing step for applying, after completion of the first initializing step, a positive second initializing pulse to the second electrodes and a positive third initializing pulse to the first electrodes.

Here, the first initializing pulse may have a ramp waveform that increases over time, and the third initializing pulse may have a ramp waveform that decreases over time.

This ramp waveform configuration allows for weak background illumination and high contrast in the initializing step.

Alternatively, the first initializing pulse may have an exponential waveform that exhibits increasing saturation over time, and the third initializing pulse may have an exponential waveform that exhibits decreasing saturation over time.

This exponential waveform configuration allows for weak background illumination and high contrast in the initializing step.

Here, by driving the second electrodes in selected lines in a different phase to second electrodes in non-selected lines nearest thereto, and also by driving a plurality of lines in the same phase (i.e. by employing multiphase connecting), it is possible to concurrently change the potential of second electrodes in like phases by using a field-effect transistor (FET) switch or the like. The need to employ a driver IC to independently drive and change potentials with respect to individual lines is thus removed, and cost savings can be realized as a result.

According to this structure, the second electrodes in even lines may be driven in phase, and the second electrodes in odd lines may be driven in phase.

As has been described above, the present invention is clearly distinguished from the prior art technology in the following ways. According to the prior art, a regular voltage is applied continuously to electrodes to which a scan pulse is not applied, irrespective of whether the electrodes are in selected or non-selected lines. According the present invention in comparison, scan pulses are applied to both the first and second electrodes in selected lines. Moreover, in a selected line, the polarity of the scan pulse applied to the first electrode is opposite in polarity to the scan pulse applied to the second electrode in a pair with the first electrode.

BEST MODE FOR CARRYING OUT THE INVENTION

A preferred embodiment of the present invention will now be described in detail with reference to the drawings, the invention of course not being limited to this embodiment.

Figure 5:
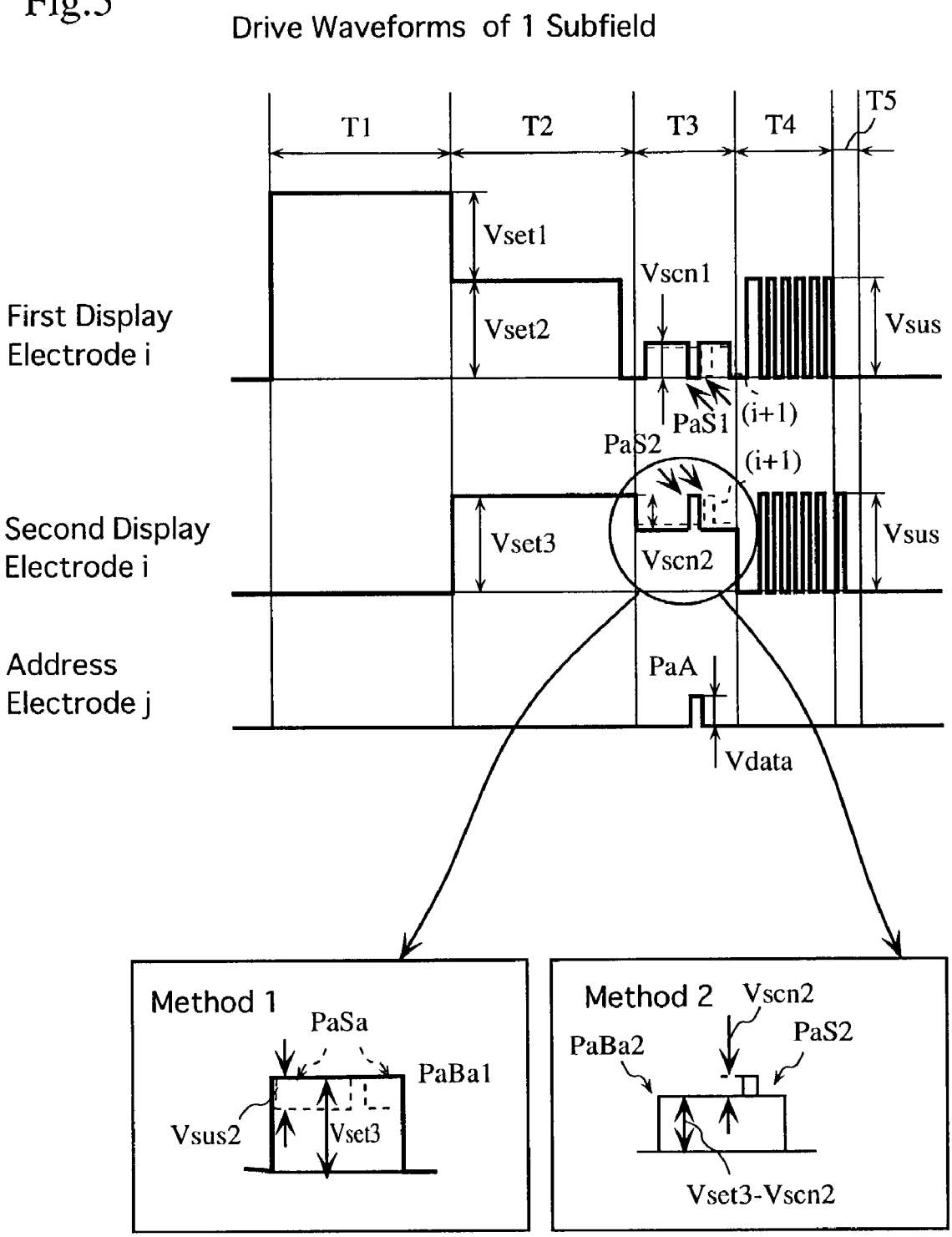
FIG. 5 shows drive waveforms relating to a method for driving the PDP according to the present embodiment.

FIG. 5 shows drive waveforms of a method for driving the PDP according to the present embodiment.

Figure 1:
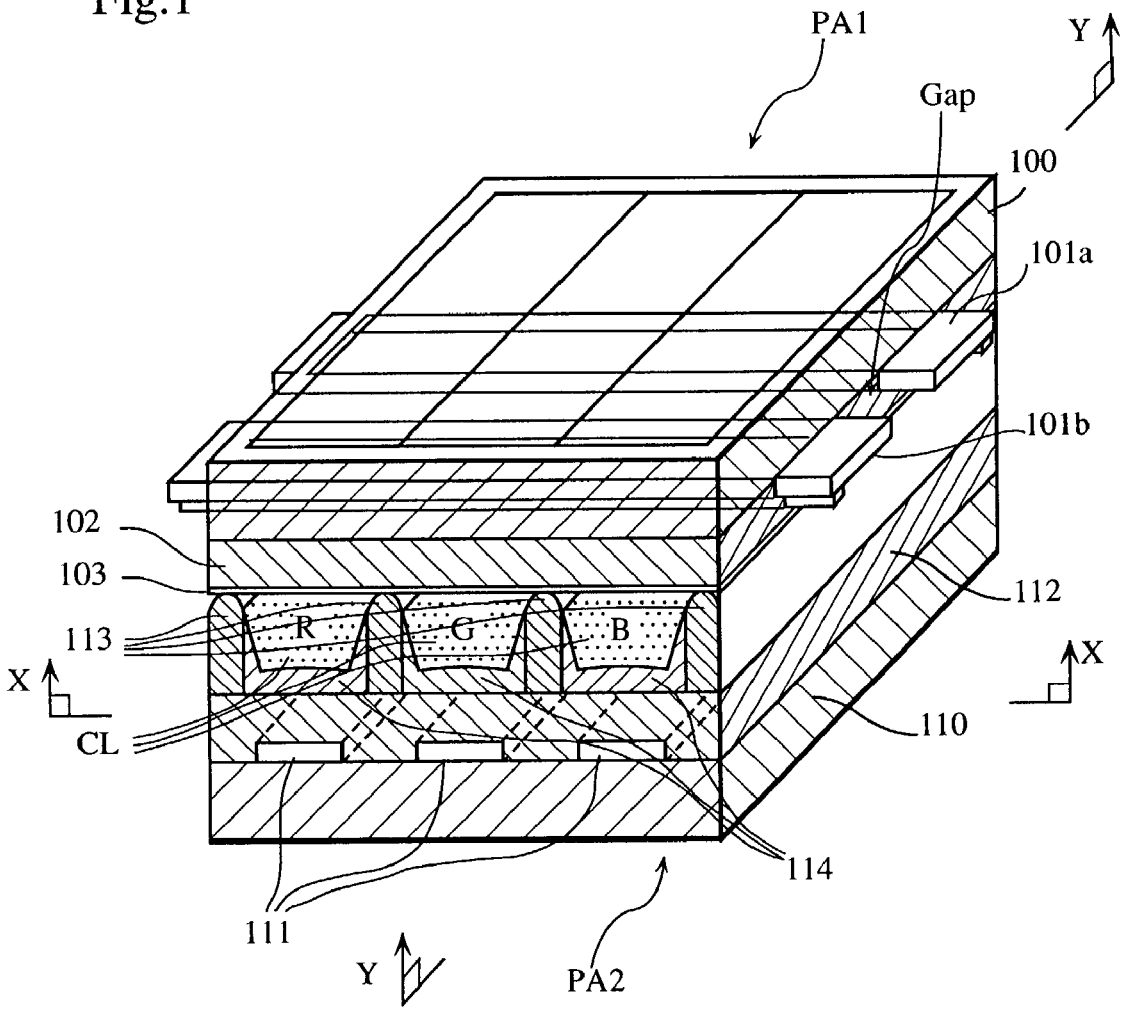
FIG. 1 is a perspective view of a main section of a PDP according to an embodiment of the invention, this structure being the same as that of a prior art PDP.
Figure 2:
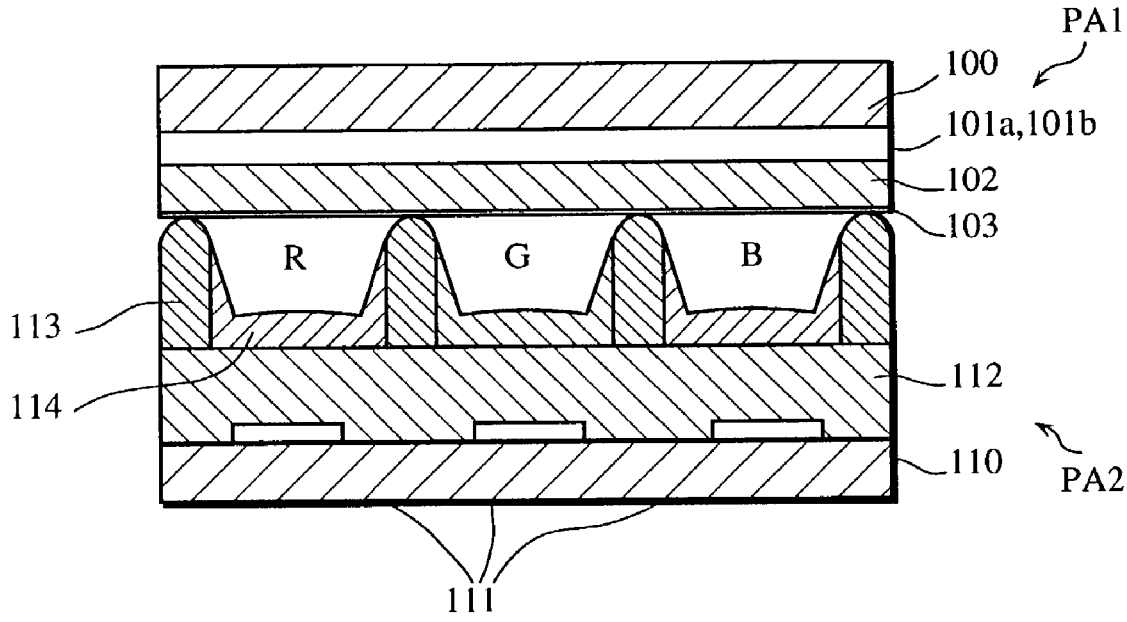
FIG. 2 shows a vertical cross-section of the PDP along an X—X axis.
Figure 3:
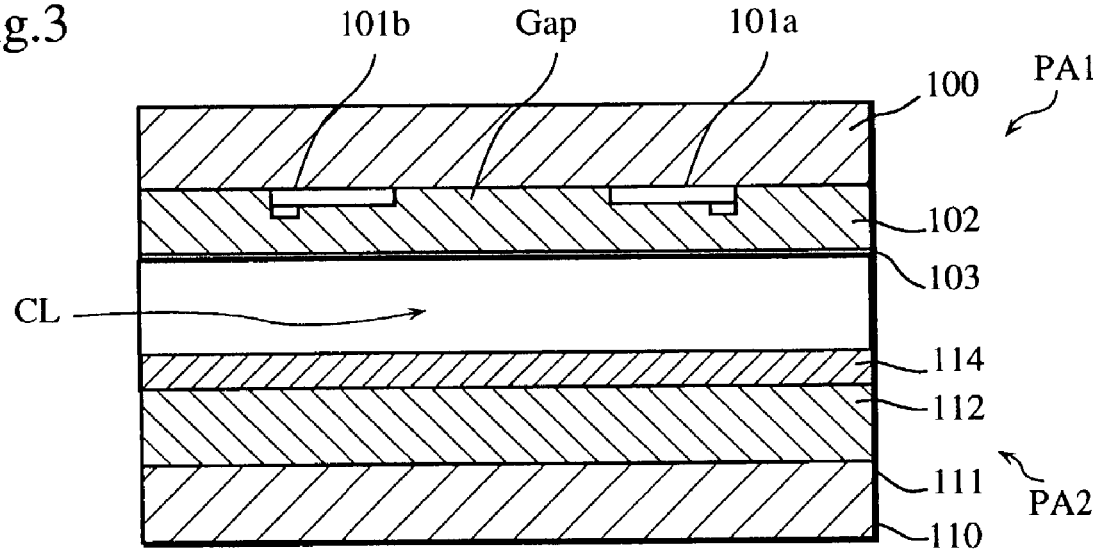
FIG. 3 shows a vertical cross-section of the PDP along a Y—Y axis.

The structure of the PDP according to the present embodiment as shown in FIGS. 1, 2 and 3 is the same as the prior art PDP, and for this reason will not be described in detail here.

As with the prior art PDP, the PDP of the present embodiment uses a field timesharing display method. According to this method, one display field is divided into a plurality of subfields, and each subfield is composed of a plurality of operation periods: a first initializing period T1, a second initializing period T2, an address period T3, a sustain period T4, and an erase period T5. An illumination weight of each subfield is determined by the number of sustain pulses applied in sustain period T4, and the gradations of one cell are expressed by selectively turning on desired subfields.

With respect to the standard NTSC signal, one display field equals 1/60 sec and is composed of 8 to 12 subfields. It is possible to display 256 gradations, for instance, when eight subfields are provided.

FIG. 5 shows voltage waveforms relating to a single subfield, these waveforms being applied within a discharge cell corresponding to the $i^{th}$ line and the $j^{th}$ column. Shown in FIG. 5 is, from the top down, the waveforms applied to the $i^{th}$ line first display electrode, the $i^{th}$ line second display electrode, and the $j^{th}$ column address electrode (note: the broken lines show the voltage waveforms applied to the respective electrodes in the $i+1^{th}$ line).

In period T1, a positive pulse Vset1+Vset2 is applied to the first electrodes, thus generating an initializing discharge between the first, second, and third electrodes within each of the discharge cells. As a result of this discharge, wall voltages are stored on the dielectric layer within each of the cells (note: reference to wall voltages being stored on the "dielectric layer" may also imply storage of the same on the phosphor layers).

In period T2, a negative pulse is applied to the first electrodes, the voltage of this pulse going from minus Vset1 to minus Vset1+Vset2. As a result, the voltage occurring at the first electrodes at the culmination of period T2 is zero.

Further, in period T2, a positive pulse (amplitude Vset3) is applied to the second electrodes. Thus at the culmination of period T2, the wall charge stored in the discharge cells in period T1 is eliminated, and the voltage occurring in each of the discharge cells is substantially the same or slightly lower than their respective discharge initiating voltages Vfs.

Generally, it is preferable for Vset2 to be substantially the same as the discharge sustaining voltage Vsus, and for Vset3 to be substantially the same or slighter higher than Vset2 (by approx. 0–30V).

The waveform of the pulses applied in periods T1 and T2 are not limited to the rectangular waveforms shown in FIG. 5. For instance, the same effects can be gained from known ramp waveforms that increase and decrease over time. The ramp waveform configuration results in weak background illumination and high contrast in the initializing period.

The same result can also be achieved when the pulses applied in periods T1 and T2 have known exponential waveforms that exhibit increasing and decreasing saturation over time. In comparison to the ramp waveform configuration, the exponential waveform configuration results in slightly weaker background illumination and slightly higher contrast in the initializing period.

In address period T3, a scan pulse is applied to the first and second electrodes such that the voltage between the first and second electrodes in cells in the non-selected $i+1^{th}$ line is lower than the voltage between the first and second electrodes in cells in the selected $i^{th}$ line. To achieve this, a positive voltage Vscn1 is applied continuously to the $i^{th}$ line first electrode when the $i^{th}$ line is not selected, and a negative first scan pulse PaS1 (amplitude Vscn1) is applied to the $i^{th}$ line first electrode when the $i^{th}$ line is written (i.e. selected).

With respect to the $i^{th}$ line second electrode, a positive voltage Vset3−Vscn2 is applied when the $i^{th}$ line is not selected, and a positive second scan pulse PaS2 (amplitude Vscn2) is applied when the $i^{th}$ line is written.

By applying the scan pulses in this manner, the voltage between the first and second electrodes in the selected $i^{th}$ line is $|0-Vset3|=Vset3$, and the voltage between the first and second electrodes in the non-selected $i+1^{th}$ line is $|Vscn1-(Vset3-Vscn2)|$. As is clear from FIG. 5, this achieves the relationship between the $i^{th}$ line and the $i+1^{th}$ line described above.

Furthermore, it is not necessary for the scan pulse applied to first electrodes in selected lines to be a negative pulse of amplitude Vscn1. The first scan pulse can be of any amplitude, so long as the potential is sufficient to generate an address discharge and the polarity is opposite to that of the second scan pulse.

The following two novel methods of applying the scan pulse to the second electrodes are possible.

Taking the $i^{th}$ line as an example, one method involves applying a negative auxiliary pulse PaSa (amplitude Vscn2) on top of a positive base pulse PaBa1 (amplitude Vset3) to the second electrode when the $i^{th}$ line is not selected, thereby generating a positive second scan pulse PaS2 (amplitude Vscn2) at the $i^{th}$ line second electrode when the $i^{th}$ line is selected.

A second method involves applying a base pulse PaBa2 (amplitude Vset3−Vscn2) continuously to the second electrode when the $i^{th}$ line is not selected, and then applying a positive second scan pulse PaS2 (amplitude Vscn2) on top of the base pulse PaBa2 when the $i^{th}$ line is selected.

Alternative methods of applying the scan pulses are of course available.

With respect to the third electrodes, a positive address pulse PaA (amplitude Vdata) is applied to the third electrodes corresponding to cells to be turned on (i.e. $i^{th}$ line/$j^{th}$ column discharge cell in the given example).

This results in a voltage occurring between the first and third electrodes in the "on" cell composed of Vdata plus a voltage that is substantially the same or slightly lower than the discharge initiating voltage, thus generating an address discharge in the "on" cell. The potential of the second electrode in the selected $i^{th}$ line is Vset3, and priming particles are generated by the address discharge. As a result of the priming particles, the discharge initiating voltage Vfs between the $i^{th}$ line first and second electrodes is reduced and a surface discharge occurs between these electrodes. Wall charge is thus stored on the surface of the dielectric layer between the $i^{th}$ line first and second electrodes in the "on" cell.

The potential of the second electrode in the non-selected $i+1^{th}$ line when the $i^{th}$ line first electrode is being scanned is maintained at substantially the same or slightly lower (up to Vscn2) than the discharge initiating voltage Vfs after completion of the initializing period.

Even if the discharge initiating voltage in cells in adjacent lines is reduced as a result of priming particles generated by the address discharge within the $i^{th}$ line/$j^{th}$ column discharge cell crossing over into these cells, an erroneous address discharge is not readily initiated since the voltage between first and second electrodes in these cells has been reduced by Vscn2.

By reducing the voltage applied to the non-selected $i^{th}$ line second electrode by more than the Vscn2 applied when the $i^{th}$ line is selected, the voltage between the selected $i^{th}$ line first electrode and the non-selected $i+1^{th}$ line (i.e. the next line to be scanned) second electrode is reduced below the voltage between the selected $i^{th}$ line first and second electrodes (i.e. a voltage of Vset3 between the first and second electrodes in the selected line versus a voltage of Vset3−Vscn2 between the first electrode in a selected line and the second electrode nearest thereto in a non-selected line; that is, the $i+1^{th}$ line second electrode in the given example). It is thus possible to suppress the crossover of priming particles into cells in non-selected lines, and effectively reduce the occurrence of erroneous addressing discussed above.

Figure 4:
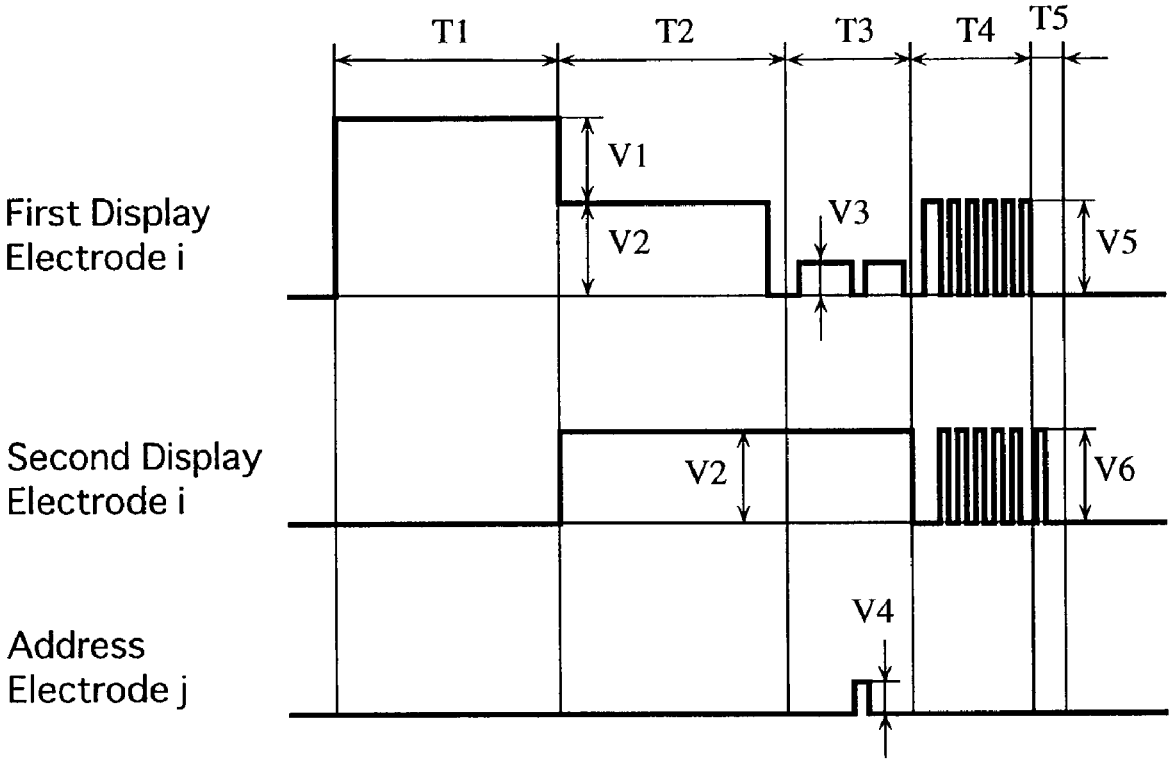
FIG. 4 shows drive waveforms relating to a method for driving the prior art PDP.

In the prior art example shown in FIG. 4, it is necessary to apply a base voltage V2 (substantially the same as Vset3) to the second electrodes in the address period. According to the present embodiment, however, a sufficient address drive is conducted in the cells to be written as a result of the scan pulses of opposite polarities applied between the first and second electrodes at the moment of writing, despite the base voltage having been reduced by Vscn2.

Naturally, the relationship between the potentials in cells in the selected $i^{th}$ line and the non-selected $i+1^{th}$ line (to be written) in the address period is substantially the same as the relationship between the potentials in cells in the selected $i^{th}$ line and the non-selected $i-1^{th}$ line (already written) When the $i^{th}$ line/$j^{th}$ column discharge cell is not selected to be turned on (i.e. not addressed), the voltage within this cell is the same as the voltage between first and second electrodes and the voltage between the first and third electrodes after completion of the second initializing period T2 (i.e. a voltage being substantially the same or slightly lower than the respective discharge initiating voltages Vfs between these electrodes).

Next, in sustain period T4, a positive sustain pulse Vsus is applied to the first electrodes and the potential of the second electrodes is maintained at zero. As a result, wall voltage (i.e. a latent image) is stored in the cells to be written, the discharge initiating voltage in these cells is surpassed, and a display discharge generated.

Generally, the voltage Vsus is maintained such that a display discharge only occurs in cells that have been written and not in cells that have not been written. Wall voltage is stored in the cells in which a display discharge has been generated, the polarity of the wall voltage being opposite to that of the applied voltage. Then, by applying a predetermined number of sustain pulses (amplitude Vsus) alternately to the first and second electrodes, a predetermined number of display illumination discharges are generated, these discharges being limited to the cells that have been addressed.

Consequently, the occurrence of erroneous display illumination in the sustain period in cells erroneously written in the address period is eliminated, making it possible to achieve superior image quality in comparison with prior art examples.

Next, in the erase period, relatively short erase pulses are applied to the second electrodes in order to terminate the display illumination and reduce the wall voltage stored within the cells. These erase pulses can, for example, be positive pulses (amplitude Vsus) having a shorter duration than the sustain pulses. As a result, no discharge would be generated, even if a sustain pulse were applied. By conducting this erase operation in the erase period it is possible to prevent a display discharge from occurring in the sustain period when no writing is to be conducted in the following subfield.

While the erase pulses can be applied to the first electrodes, it is preferable to apply them to the second electrodes since this helps to weaken the illumination in the following initialization period. Also, the erase pulses need not be of short duration. For example, the same effects can be achieved by maintaining a weak discharge in the form of an increasing ramp waveform, and thus suppressing the generation of wall voltage within the cells.

Figure 6:
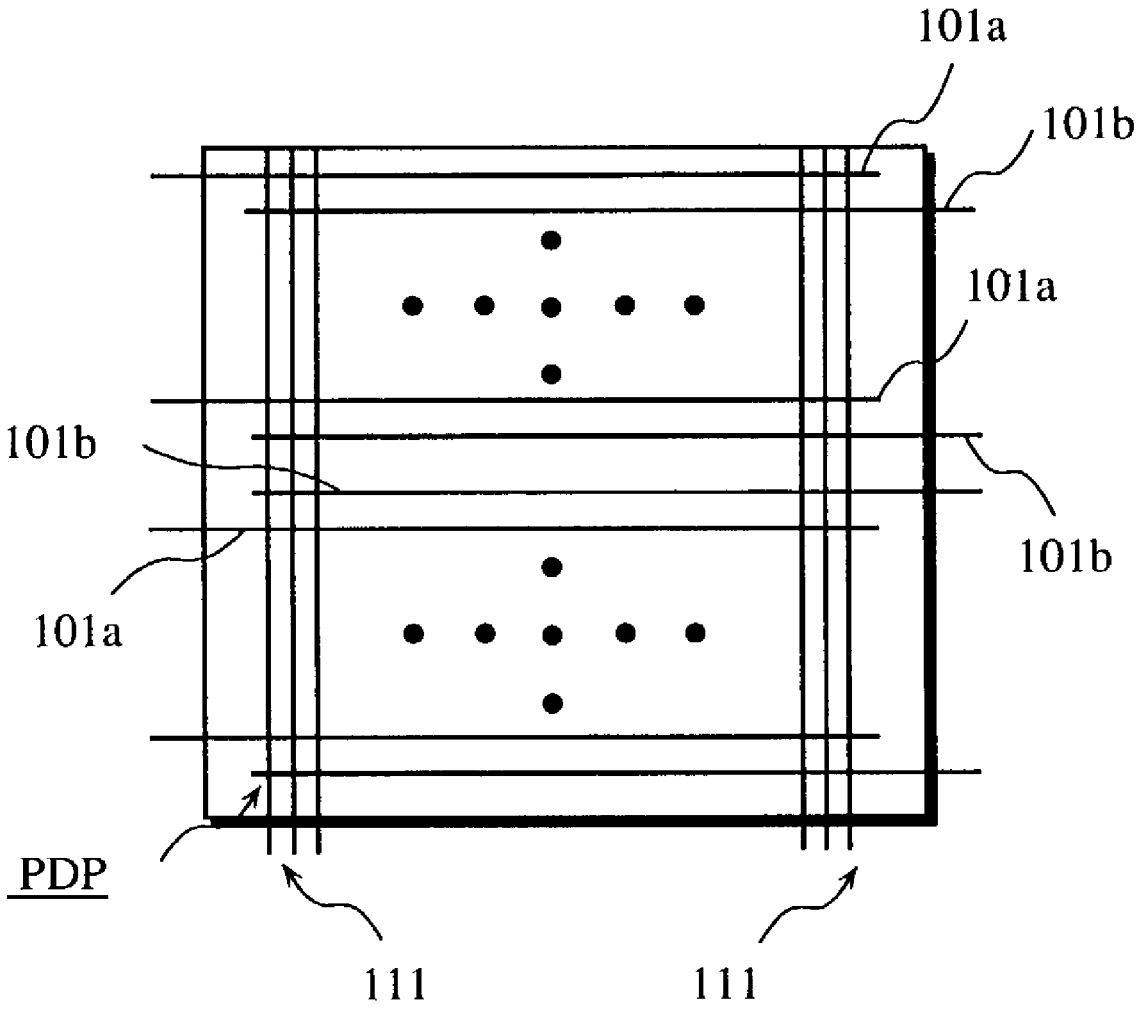
FIG. 6 shows a variation of the arrangement of first and second display electrodes in the PDP according to the present embodiment.

It is also possible to arrange to electrodes in the following manner. FIG. 6 shows such an arrangement.

As shown in FIG. 6, it is possible to arrange the electrodes such that a first electrode in one line is adjacent to a first electrode in another line, and a second electrode in one line is adjacent to a second electrode in another line. In this way the occurrence of erroneous discharge can be suppressed, even when the gap between discharge cells is reduced, thereby widening the illumination surface between the electrodes within each of the cells. Specifically, as shown in FIG. 5, the potential of the first electrode in the selected line in period T3 is zero V and the potential of the a first electrode in a non-selected line is Vscn1, giving a potential difference of Vscn1. Thus the potential difference between adjacent lines according to this electrode configuration is lower than when the first and second electrodes are arranged alternately. As a result, the chance of cells in non-selected lines being erroneously written is further reduced, and image quality further enhanced.

In summary, the chances of priming particles being electrically attracted to and crossing over into adjacent non-selected lines is reduced by arranging the electrodes in this manner, because of the decrease in voltage between the discharge cells in selected lines and non-selected lines. As a result, the possibility of erroneous discharge occurring is further reduced.

A drive circuit for operating the above drive method will now be described in detail.

Figure 7:
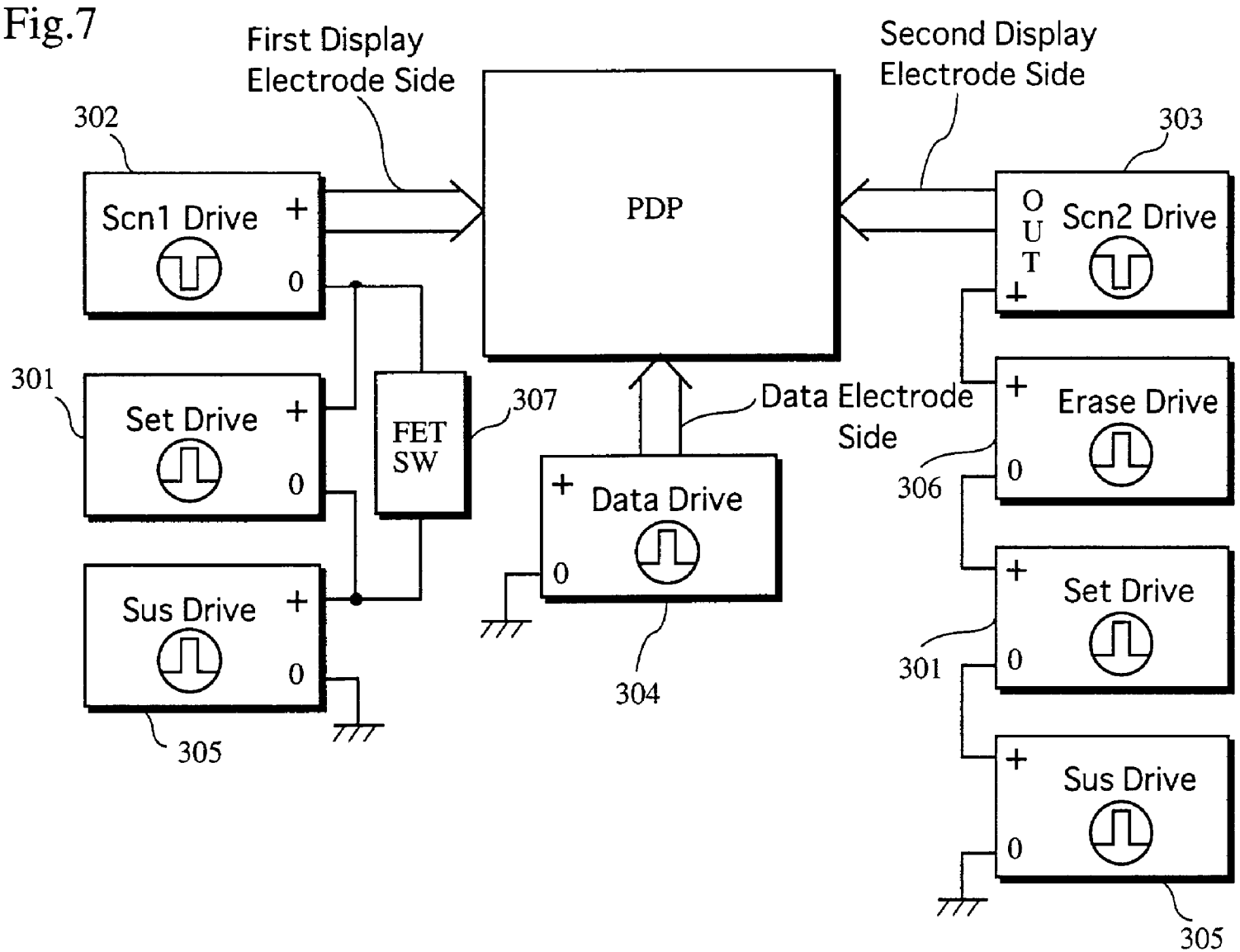
FIG. 7 is a block diagram showing an exemplary drive circuit according to the present embodiment.

FIG. 7 is a block diagram showing a detailed structure of the drive circuit.

The drive circuit includes initializing circuits 301 for conducting the initializing, a first scan pulse circuit 302 for applying a negative first scan pulse to the first electrodes in selected lines, a second scan pulse circuit 303 for applying a positive second scan pulse to the second electrodes in selected lines, a data drive circuit 304 for writing display data, sustain drive circuits 305 for conducting a sustain drive in order to display data written by data drive circuit 304, and an erase circuit 306 for generates waveforms in order to erase the wall voltages corresponding to display image data.

Initializing circuits 301 generate the waveforms in the first and second initializing period T1 and T2, as shown in FIG. 5. When the initializing voltage in period T2 is equal to the sustain voltage Vsus, it may be possible to omit the initializing circuit 301 provided on the side of the second electrodes.

First scan pulse circuit 302 applies a negative first scan pulse (amplitude Vscn1) to first electrodes that are to be written, the first scan pulse being applied on top of a base pulse (positive pulse of amplitude Vscn1).

Second scan pulse circuit 303 executes a first pulse generation method, and applies a negative auxiliary pulse (amplitude Vscn2) on top of a base pulse (positive pulse of amplitude Vset3) to a second electrode that is not being written, the application of this negative auxiliary pulse enabling second scan pulse circuit 303 to apply a second scan pulse (amplitude Vscn2) to the second electrode when it is selected (i.e. written).

As shown in FIG. 5, sustain drive circuits 305 apply a positive pulse Vsus alternately to the first and second electrodes.

Data drive circuit 304 applies a positive pulse Vdata to the third electrodes to be written with display data.

Erase circuit 306 applies an erase pulse to the first and/or second electrodes.

It is preferable for an output line of initializing drive circuits 301 to be such that they are short circuited by a switch circuit 307 in sustain period T4. Switch circuit 307 is shown in FIG. 7 to be on the side of the first electrodes, although it can be provided on the side of the second electrodes, or omitted from the structure altogether.

In address period T3, first scan pulse circuit 302 applies a negative pulse on top of a positive base pulse (amplitude Vscn1) to first electrodes in selected lines, and second scan pulse circuit 303 applies a negative pulse on top of a positive base pulse (amplitude Vset3) to second electrodes in non-selected lines, thus operating the drive method shown in FIG. 5. In the prior art drive circuit shown in FIG. 4, a positive pulse (amplitude V2) is applied uniformly to the second electrodes irrespective of whether they are in selected or non-selected lines. In other words, in the prior art drive circuit, the applied waveforms cannot be changed depending on whether the respective lines have been selected or not. Because the discharge initiating voltage cannot be selectively reduced in second electrodes that are in non-selected lines, the possibility exists that cells in non-selected lines will be erroneously written. In the drive circuit according to the present embodiment, the second scan pulse circuit 303 is connected electrically to each of the second electrodes. This structure allows the drive waveforms to be changed independently depending on whether a particular line is selected or not, thereby allowing the voltage between first and second electrodes in cells that are in non-selected lines to be selectively reduced. As a result, the erroneous writing of cells can be prevented.

However, it is not necessary for second scan pulse circuit 303 to be connected independently to each of the second electrodes. Second scan pulse circuit 303 can be connected to a plurality of second electrodes as a group; for instance, second electrodes in a predetermined number of pairs (e.g. 2 pairs) in even lines and second electrodes in a predetermined number of pairs (e.g. 2 pairs) in odd lines. This configuration allows selected lines to be driven in a different phase to nearest adjacent lines, and also allows for a predetermined number of lines that are separated by a plurality of lines to be driven in the same phase (i.e. multiphase connecting). By using a FET switch or the like it thus becomes possible to concurrently change the potential of second electrodes in any particular phase, without needing to employ a driver IC to independently drive and change potentials with respect to individual lines. Cost savings can be achieved as a result.

Finally, as is well known, the ribs can be formed as a grid rather than in a stripe pattern. The grid can be formed by using auxiliary ribs to link together ribs formed in a stripe pattern, this being a configuration disclosed, for example, in unexamined patent application publication 10-321148 filed in Japan.

INDUSTRIAL APPLICABILITY

The invention is applicable in the field of plasma display panels used for image display in computers, televisions, and the like.

The invention claimed is:

1. A plasma display panel drive method using a field timesharing display method, the plasma display panel including a first panel member and a second panel member, a plurality of first and second electrodes being provided on the first panel member so as to extend parallel to each other, and a plurality of third electrodes being provided on the second panel member so as to extend orthogonally to the first and second electrodes, comprising:

an address step of writing data by applying an address pulse to a third electrode and a first scan pulse sequentially to the first electrodes; and a sustain step of sustaining an illumination by applying a sustain pulse between the first and second electrodes after completion of the address step, wherein display of an image in a subfield of a field is achieved by conducting the address step and the sustain step, and in the address step, a second scan pulse of opposite polarity to the first scan pulse is applied to a second electrode in a pair with a first electrode to which the first scan pulse is being applied, but is not applied to a second electrode in a pair with a first electrode to which the first scan pulse is not being applied.

2. A method according to claim 1, further comprising:

an initializing step of initializing a charge of the plasma display panel, wherein the initializing step is executed prior to the address step and includes a first initializing step of applying a positive first initializing pulse to the first electrodes; and a second initializing step of applying, after completion of the first initializing step, a positive second initializing pulse to the second electrodes and a positive third initializing pulse to the first electrodes.

3. The method according to claim 2, wherein the first initializing pulse has a ramp waveform that increases over time, and the third initializing pulse has a ramp waveform that decreases over time.

4. The method according to claim 2, wherein the first initializing pulse has an exponential waveform that exhibits increasing saturation over time, and the third initializing pulse has an exponential waveform that exhibits decreasing saturation over time.

5. A plasma display panel drive method using a field timesharing display method, the plasma display panel including a first panel member and a second panel member, a plurality of first and second electrodes being provided on the first panel member so as to extend parallel to each other, and a plurality of third electrodes being provided on the second panel member so as to extend orthogonally to the first and second electrodes, comprising:

an address step of writing data by applying an address pulse to a third electrode and a first scan pulse sequentially to the first electrodes; and a sustain step of sustaining an illumination by applying a sustain pulse between the first and second electrodes after completion of the address step; wherein display of an image in a subfield of a field is achieved by conducting the address step and the sustain step;

in the address step, a second scan pulse of opposite polarity to the first scan pulse is applied to a second electrode in a pair with a first electrode to which the first scan pulse is being applied; and in the plasma display panel, each first electrode is provided adjacent to another first electrode, and each second electrode is provided adjacent to another second electrode.

6. A method according to claim 5, further comprising:

an initializing step of initializing a charge of the plasma display panel, wherein the initializing step is executed prior to the address step and includes a first initializing step of applying a positive first initializing pulse to the first electrodes; and a second initializing step of applying, after completion of the first initializing step, a positive second initializing pulse to the second electrodes and a positive third initializing pulse to the first electrodes.

7. A plasma display panel drive method using a field timesharing display method, the plasma display panel including a first panel member and a second panel member, a plurality of first and second electrodes being provided on the first panel member so as to extend parallel to each other, and a plurality of third electrodes being provided on the second panel member so as to extend orthogonally to the first and second electrodes, the method comprising:

an address step of writing data by applying an address pulse to a third electrode and a first scan pulse sequentially to the first electrodes; and a sustain step of sustaining an illumination by applying a sustain pulse between the first and second electrodes after completion of the address step, wherein display of an image in a subfield of a field is achieved by conducting the address step and the sustain step, in the address step, a second scan pulse is applied to a second electrode in a pair with a first electrode in a selected line to which the first scan pulse is being applied, such that a voltage between the first and second electrodes in the selected line is greater than a voltage between the first electrode in the selected line and a second electrode nearest thereto in a non-selected line; and in the address step, the second scan pulse is not applied to a second electrode in a pair with a first electrode in a non-selected line to which the first scan pulse is not being applied.

8. A method according to claim 7, further comprising:

an initializing step of initializing a charge of the plasma display panel, wherein the initializing step is executed prior to the address step and includes a first initializing step of applying a positive first initializing pulse to the first electrodes; and a second initializing step of applying, after completion of the first initializing step, a positive second initializing pulse to the second electrodes and a positive third initializing pulse to the first electrodes.

9. A plasma display panel drive method using a field timesharing display method, the plasma display panel including a first panel member and a second panel member, a plurality of first and second electrodes being provided on the first panel member so as to extend parallel to each other, and a plurality of third electrodes being provided on the second panel member so as to extend orthogonally to the first and second electrodes, the method comprising:

an address step of writing data by applying an address pulse to a third electrode and a first scan pulse sequentially to the first electrodes; and a sustain step of sustaining an illumination by applying a sustain pulse between the first and second electrodes after completion of the address step; wherein display of an image in a subfield of a field is achieved by conducting the address step and the sustain step;

in the address step, a second scan pulse is applied to a second electrode in a pair with a first electrode in a selected line to which the first scan pulse is being applied, such that a voltage between the first and second electrodes in the selected line is greater than a voltage between the first electrode in the selected line and a second electrode nearest thereto in a non-selected line; and in the plasma display panel, each first electrode is provided adjacent to another first electrode, and each second electrode is provided adjacent to another second electrode.

10. A method according to claim 9, further comprising:

an initializing step of initializing a charge of the plasma display panel, wherein the initializing step is executed prior to the address step and includes a first initializing step of applying a positive first initializing pulse to the first electrodes; and a second initializing step of applying, after completion of the first initializing step, a positive second initializing pulse to the second electrodes and a positive third initializing pulse to the first electrodes.

11. A plasma display device, comprising:

a plasma display having a first panel member and a second panel member, a plurality of first and second electrodes being provided on the first panel member so as to extend parallel to each other, and a plurality of third electrodes being provided on the second panel member so as to extend orthogonally to the first and second electrodes; and a drive unit for operating a field timesharing display method, wherein the drive unit includes a scan circuit for sequentially applying scan pulses to each line of a plurality of adjacent lines, the scan pulses applied to each line consisting essentially of a first scan pulse and a second scan pulse applied respectively to a first electrode and a second electrode in the line such that a voltage between the first and second electrodes in the selected line is greater than a voltage between the first electrode in the selected line and a second electrode nearest thereto in a non-selected line.

12. The device, according to claim 11, wherein the drive unit includes an initializing circuit for initializing a charge of the plasma display, the initializing circuit executing (i) a first initializing step for applying a positive first initializing pulse to the first electrodes, and (ii) a second initializing step for applying, after completion of the first initializing step, a positive second initializing pulse to the second electrodes and a positive third initializing pulse to the first electrodes.

13. The device according to claim 12, wherein a plurality of second electrodes are driving in phase, and the second electrodes in selected lines are driven in a different phase to the second electrodes in non-selected lines nearest thereto.

14. A plasma display device, comprising:

a plasma display having a first panel member and a second panel member, a plurality of first and second electrodes being provided on the first panel member so as to extend parallel to each other, and a plurality of third electrodes being provided on the second panel member so as to extend orthogonally to the first and second electrodes; and a drive unit for operating a field timesharing display method, wherein the drive unit includes a scan circuit for sequentially applying scan pulses to each line of a plurality of lines, the scan pulses applied to each line comprising a first scan pulse and a second scan pulse applied respectively to a first electrode and a second electrode in the line such that a voltage between the first and second electrodes in the selected line is greater than a voltage between the first electrode in the selected line and a second electrode nearest thereto in a non-selected line; wherein in the plasma display, each first electrode is provided adjacent to another first electrode, and each second electrode is provided adjacent to another second electrode.

15. The device according to claim 14, wherein the drive unit includes an initializing circuit for initializing a charge of the plasma display, the initializing circuit executing (i) a first initializing step for applying a positive first initializing pulse to the first electrodes, and (ii) a second initializing step for applying, after completion of the first initializing step, a positive second initializing pulse to the second electrodes and a positive third initializing pulse to the first electrodes.

16. The device according to claim 15, wherein the first initializing pulse has a ramp waveform that increases over time, and the third initializing pulse has a ramp waveform that decreases over time.

17. The device according to claim 15, wherein the first initializing pulse has an exponential waveform that exhibits increasing saturation over time, and the third initializing pulse has an exponential waveform that exhibits decreasing saturation over time.

* * * * *